US009994039B2

(12) United States Patent
Sagegami et al.

(10) Patent No.: US 9,994,039 B2
(45) Date of Patent: Jun. 12, 2018

(54) LIQUID EJECTING APPARATUS

(71) Applicant: SEIKO EPSON CORPORATION, Tokyo (JP)

(72) Inventors: Akiko Sagegami, Shiojiri (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/422,222

(22) Filed: Feb. 1, 2017

(65) Prior Publication Data

US 2017/0225483 A1 Aug. 10, 2017

(30) Foreign Application Priority Data

Feb. 5, 2016 (JP) ..... 2016-021155

(51) Int. Cl.

*B41J 2/175* (2006.01)
*B41J 29/02* (2006.01)
*B41J 29/13* (2006.01)

(52) U.S. Cl.

CPC ..... *B41J 2/17596* (2013.01); *B41J 2/175* (2013.01); *B41J 2/1752* (2013.01); *B41J 2/17513* (2013.01); *B41J 29/02* (2013.01); *B41J 29/13* (2013.01); *B41J 2002/17516* (2013.01)

(58) Field of Classification Search

CPC .. B41J 2/17553; B41J 2/1752; B41J 2/17513; B41J 2/175; B41J 2/17523; B41J 2/17509; B41J 2/17596; B41J 2/17503; B41J 2/18; B41J 2/17506; B41J 29/02; B41J 29/13

USPC ..... 347/85, 86, 84

See application file for complete search history.

(56) References Cited

U.S. PATENT DOCUMENTS

2005/0088493 A1* 4/2005 Koga ..... B41J 2/17509 347/85
2014/0098166 A1 4/2014 Suzuki et al.

FOREIGN PATENT DOCUMENTS

JP 2013-154573 8/2013
JP 2014-034191 2/2014

* cited by examiner

*Primary Examiner* — Jannelle M Lebron
(74) *Attorney, Agent, or Firm* — Workman Nydegger

(57) ABSTRACT

A liquid ejecting apparatus includes a liquid ejecting head that ejects a liquid, a liquid supply system that supplies a liquid to the liquid ejecting head, and a support member provided with a guide portion that supports and guides at least a part of the liquid supply system. Removable joint portions are provided at both ends of the liquid supply system including the part, and a plurality of types of liquid supply systems can be mounted on the support member.

14 Claims, 14 Drawing Sheets

LIQUID EJECTING APPARATUS

BACKGROUND

1. Technical Field

The present invention relates to a liquid ejecting apparatus.

2. Related Art

As an exemplary liquid ejecting apparatus, an ink jet printer which ejects ink (a liquid) from an ink jet head (a liquid ejecting head) and performs printing on a paper sheet (a recording medium) is proposed (see, for example, JP-A-2013-154573).

Specifications required for a supply portion which supplies a liquid to a head are determined by liquid ejection capability of the head to be mounted. Therefore, the supply portion employs different configurations depending on the ejection capability of the head. The head, the supply portion, and a casing are generally designed as an integrated part. If the type of the supply portion is changed, a structure of the casing to which the supply portion is attached needs to be changed, and manufacturing cost and management cost increase.

SUMMARY

An advantage of some aspects of the invention is that a liquid ejecting apparatus in which common parts can be used in various types of products with different required specifications is provided.

According to an aspect of the invention, a liquid ejecting apparatus includes a liquid ejecting head that ejects a liquid, a liquid supply system that supplies a liquid to the liquid ejecting head, and a support member provided with a guide portion that supports and guides at least a part of the liquid supply system, in which removable joint portions are provided at both ends of the liquid supply system including the part, and plural types of liquid supply systems can be mounted on the support member. With this configuration, plural types of liquid supply systems can be mounted. Different types of liquid supply systems are used depending on ejection capability of the liquid ejecting head. With this configuration, a common support member can be used in plural types of liquid ejecting apparatuses with different ejection capabilities. Thus, common parts can be used to reduce manufacturing cost and parts management cost.

In the above-described liquid ejecting apparatus, the liquid supply system in accordance with liquid ejection capability of the liquid ejecting head among plural types of the liquid supply systems may be mounted on the support member. With this configuration, common parts can be used to reduce manufacturing cost and parts management cost in plural types of liquid ejecting apparatuses with different liquid ejection capabilities of the heads, that is, in plural types of liquid ejecting apparatuses with different liquid supply capabilities (i.e., tubular diameters) of flow paths depending on liquid ejection capabilities.

In above-described liquid ejecting apparatus, the guide portion may include a guide that supports and guides a flow path of the liquid supply system together with the support member along an extension direction in which the liquid supply system extends. With this configuration, the liquid supply system can be easily supported and guided with the guide of the guide portion.

In the above-described liquid ejecting apparatus, the guide portion may be removably attached to the support member. With this configuration, since the removable guide portion is provided, plural types of guide portions corresponding to tubular diameters of plural types of liquid supply systems can be prepared, and the guide portion can be selected in accordance with the tubular diameter and mounted on the support member to support and guide the liquid supply system.

In the above-described liquid ejecting apparatus, the guide portion may be movably attached to the support member. With this configuration, since the movable guide portion is provided, the guide portion can be moved depending on the tubular diameter of the liquid supply system to support and guide the liquid supply system.

In the above-described liquid ejecting apparatus, plural types of guide portions that support and guide the plural types of the liquid supply systems, respectively, may be provided in the support member. With this configuration, plural types of guide portions can be provided depending on supply capacities of the liquid supply systems, such as plural types of tubular diameters, and the optimal guide portion for the tubular diameter can be selected to support and guide the liquid supply system.

In the above-described liquid ejecting apparatus, the liquid supply system may include a transport auxiliary apparatus that assists transport of the liquid, and the support member may include a fixing structure which supports and fixes the transport auxiliary apparatus. With this configuration, even if a transport auxiliary apparatus is provided in the liquid supply system and liquid ejection capability is improved, the liquid supply system can be supported since the fixing structure for supporting and fixing the transport auxiliary apparatus is included.

In the above-described liquid ejecting apparatus, the liquid supply system may include a circulating portion that has a circulation flow path and a circulator pump to circulate the liquid, removable joint portions may be provided at both ends of the circulating portion, and at least one of the guide portion that supports the circulation flow path and a fixing structure that supports and fixes the circulator pump may be provided in the support member. With this configuration, even if a circulation flow path and a circulator pump are provided in the liquid supply system, the liquid supply system can be supported while supporting at least one of the circulation flow path and the circulator pump.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
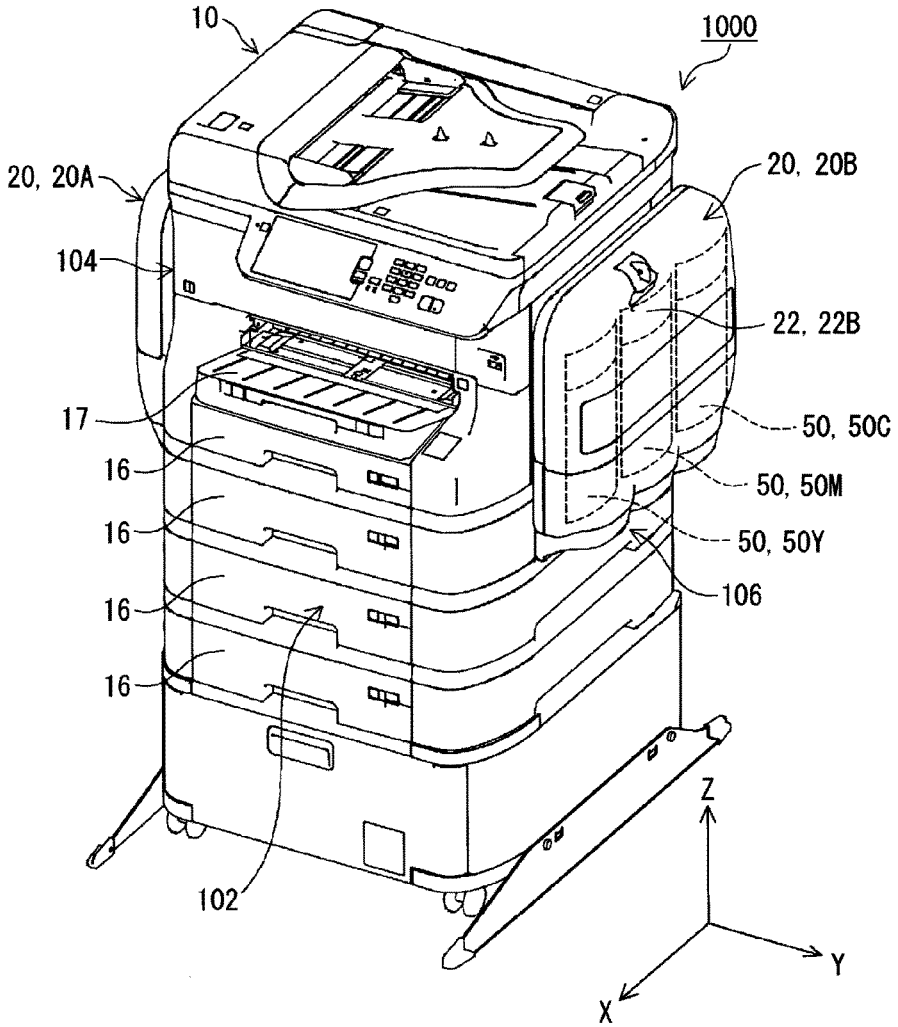
FIG. 1 is a perspective view illustrating an exterior of an entire liquid ejecting apparatus in a first embodiment.

Hereinafter, embodiments of a liquid ejecting apparatus according to the invention will be described with reference to the drawings. In the drawings used for the description below, the size of each part is reduced or magnified so that each part becomes recognizable.

First Embodiment

Figure 2:
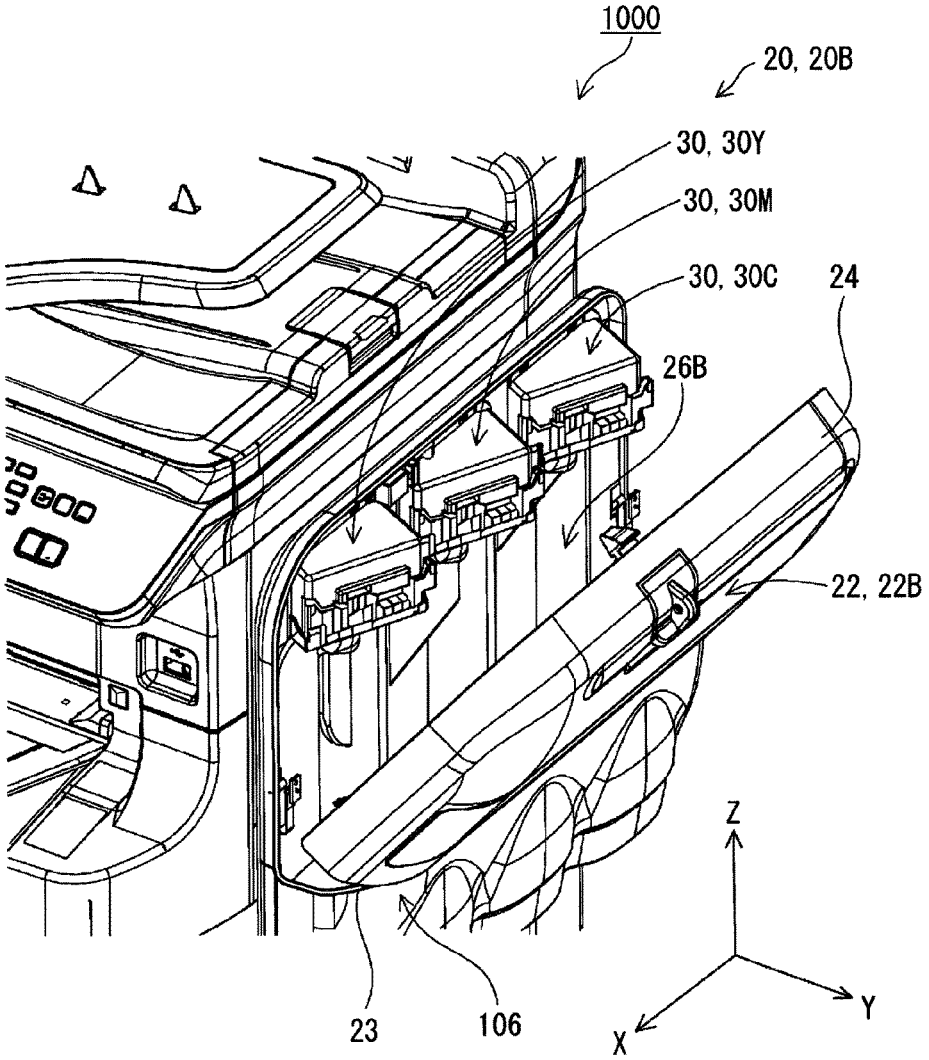
FIG. 2 is a perspective view illustrating the liquid ejecting apparatus in the first embodiment with a side portion opened.

FIG. 1 is a perspective view illustrating an exterior of an entire liquid ejecting apparatus 1000 in a first embodiment of the invention. FIG. 2 is a perspective view illustrating the liquid ejecting apparatus 1000 in the first embodiment of the invention with a side portion opened. An XYZ orthogonal coordinate system is set in each drawing as needed. The front-rear direction of the liquid ejecting apparatus 1000 is defined as an X-axis direction, a direction perpendicularly crossing the X-axis direction in a horizontal plane is defined as a Y-axis direction (a left-right direction), and a direction perpendicularly crossing the X-axis direction and the Y-axis direction (an up-down direction) is defined as a Z-axis direction.

As illustrated in FIG. 1, the liquid ejecting apparatus 1000 includes an apparatus main body 10 and two liquid supply apparatuses 20. In a usage condition of the liquid ejecting apparatus 1000, the apparatus main body 10 is installed on a horizontal surface defined by the X-axis and the Y-axis. The liquid supply apparatuses 20 supply ink as a liquid to the apparatus main body 10. Liquid containers 50 containing liquids can be removably connected (attached) to the liquid supply apparatuses 20. In the present embodiment, package type liquid containers 50 containing liquids are used.

The apparatus main body 10 is an ink jet printer. The apparatus main body 10 includes feed trays 16 and a discharge tray 17. The feed trays 16 and the discharge tray 17 are provided on an apparatus front side 102 of the apparatus main body 10. Plural feed trays 16 are provided at different height positions in the vertical direction. Recording media (for example, paper sheets) on which an image, such as characters, is printed (recorded) by the apparatus main body 10 are contained in the feed trays 16. Recording media on which an image is recorded by the apparatus main body 10 are discharged on the discharge tray 17.

The two liquid supply apparatuses 20 are provided on an apparatus left side 104 and an apparatus right side 106 of the apparatus main body 10. The liquid supply apparatus 20 provided on the apparatus left side 104 is referred to as a first liquid supply apparatus 20A, and the liquid supply apparatus 20 provided on the apparatus right side 106 is referred to as a second liquid supply apparatus 20B. When the first and the second liquid supply apparatuses 20A and 20B are used without distinction, these are referred to as the liquid supply apparatus 20.

The liquid supply apparatus 20 includes a case member 22, a liquid container 50, and a detachable unit 30 (FIG. 2). One liquid container 50 and one detachable unit 30 are accommodated in the first liquid supply apparatus 20A (later-described FIG. 3), and three liquid containers 50 and three detachable units 30 are accommodated in the second liquid supply apparatus 20B. The number of the liquid container 50 and the number of the detachable units 30 are illustrative only.

Different types of liquids are contained (filled) in the four liquid containers 50. In the present embodiment, liquids of yellow (Y), magenta (M), cyan (C), and black (K) are contained in the different liquid containers 50. A liquid container 50K (later-described FIG. 3) containing a black liquid is accommodated in an accommodation space portion 26A inside a case member 22A (a third case member) of the first liquid supply apparatus 20A. A liquid container 50C containing a cyan liquid, a liquid container 50M containing a magenta liquid, and a liquid container 50Y containing a yellow liquid are accommodated in an accommodation space portion 26B (FIG. 2) inside a case member 22B of the second liquid supply apparatus 20B.

The liquid container 50 is detachably mounted on the detachable unit 30. The liquid container 50C is mounted on the detachable unit 30C illustrated in FIG. 2, the liquid container 50M is mounted on the detachable unit 30M, and the liquid container 50Y is mounted on the detachable unit 30Y. The detachable unit 30 is disposed inside the case member 22. When the liquid container 50 is mounted on the detachable unit 30, the liquid contained in the liquid container 50 is supplied to a liquid ejecting head 60 (later-described FIG. 3) of the apparatus main body 10 by a supply mechanism (not illustrated) of the apparatus main body 10 which has a pumping function.

As illustrated in FIG. 2, the case member 22 can be opened and closed by moving another end 24 about one end 23 which is pivotably connected to the apparatus main body 10. After the liquid contained in the liquid container 50 is consumed, a user opens the case member 22 and removes the empty liquid container 50 from the detachable unit 30.

The user mounts a new liquid container 50 on the detachable unit 30 and closes the case member 22.

Figure 3:
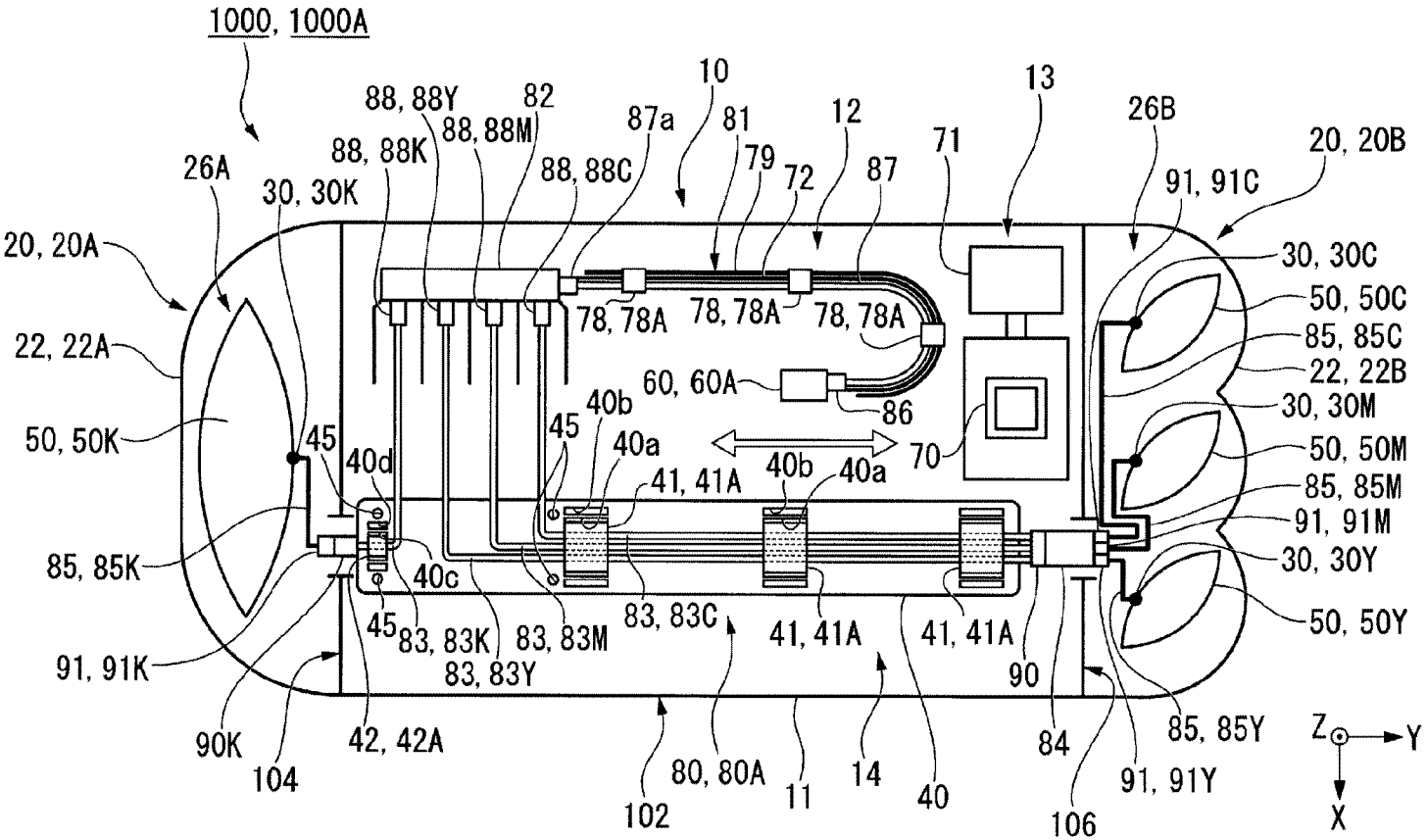
FIG. 3 is a schematic configuration diagram illustrating an interior of a liquid spray apparatus in the first embodiment, which is a first liquid ejecting apparatus.
Figure 4:
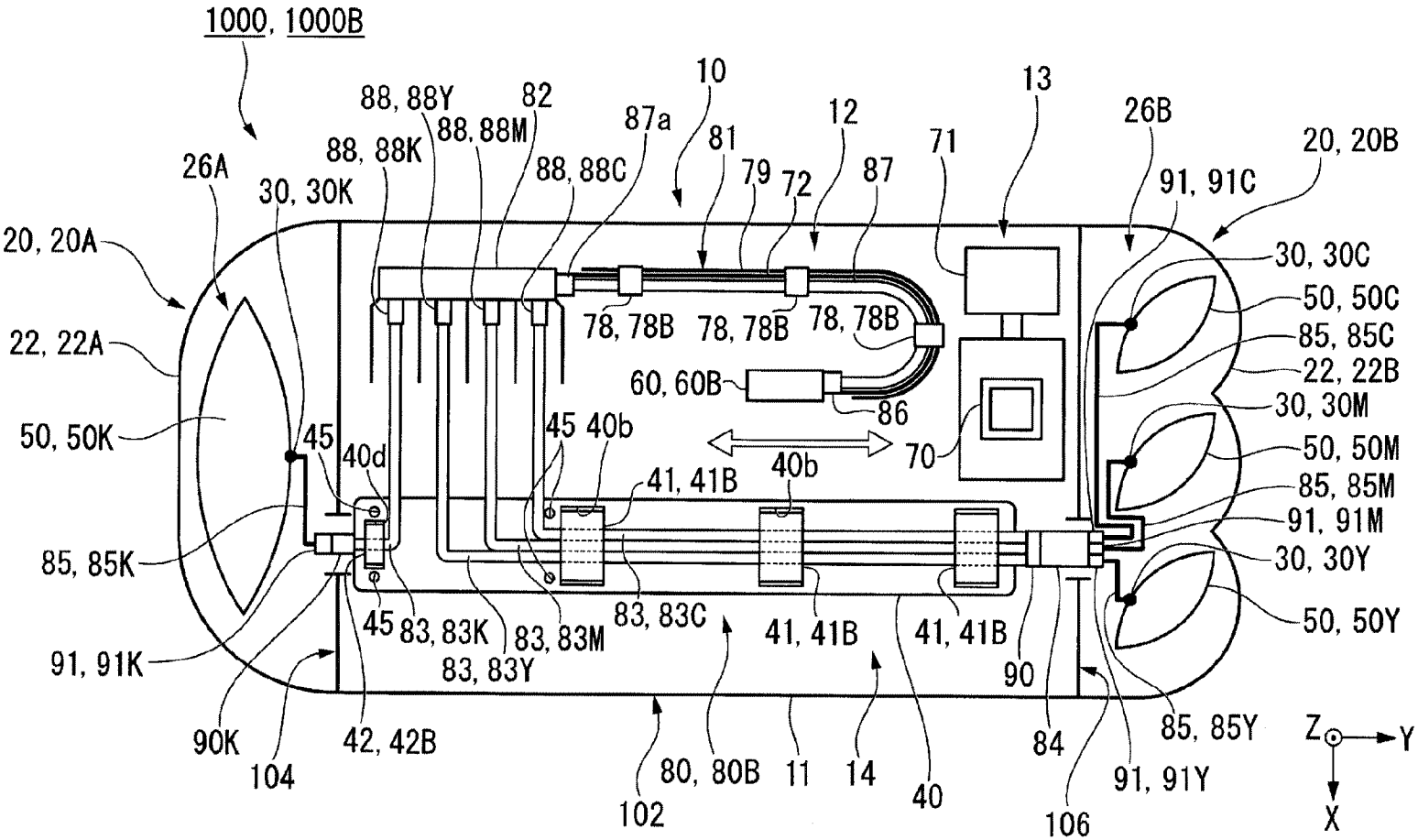
FIG. 4 is a schematic configuration diagram illustrating an interior of a liquid spray apparatus in the first embodiment, which is a second liquid ejecting apparatus.
Figure 5:
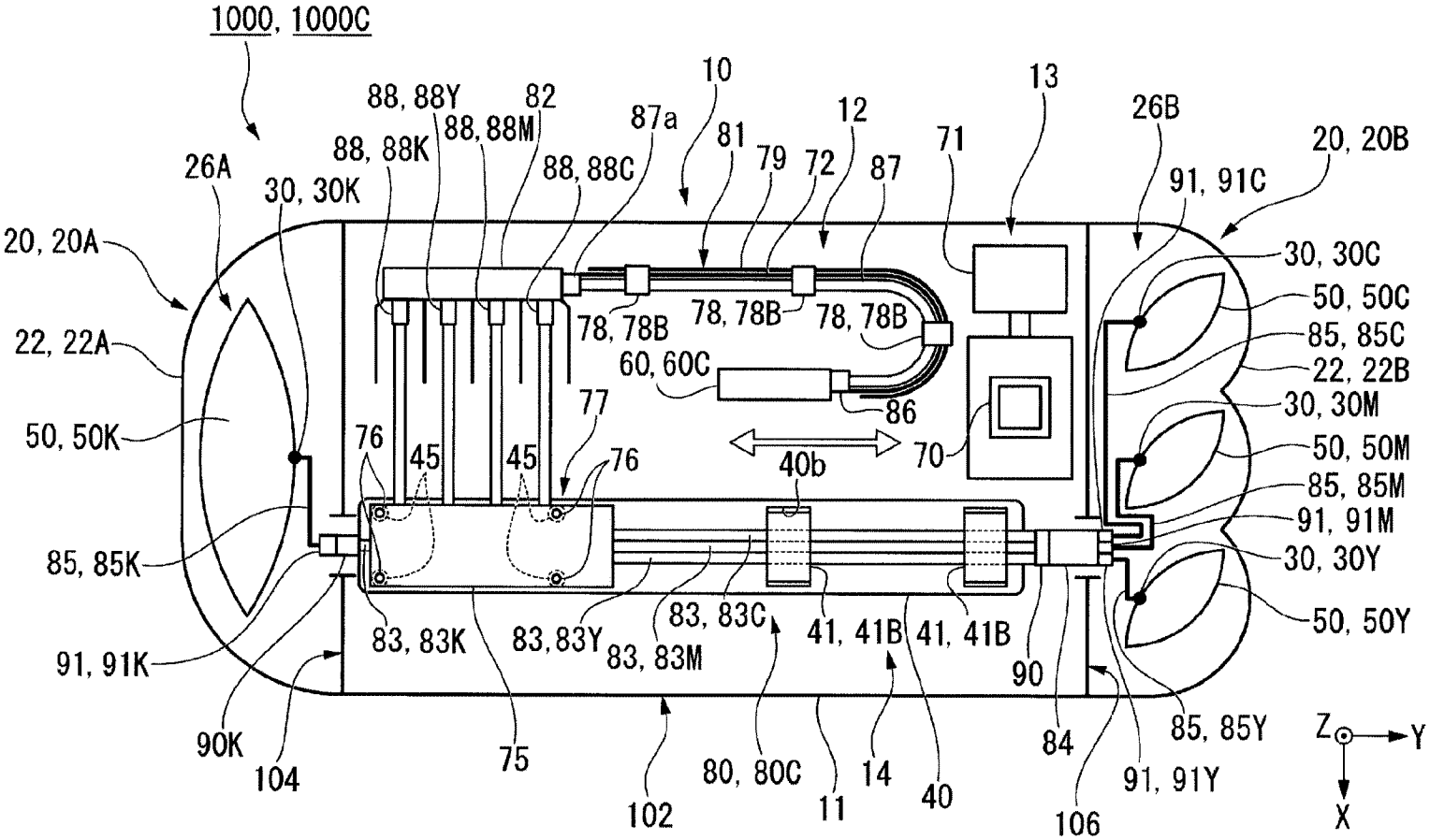
FIG. 5 is a schematic configuration diagram illustrating an interior of a liquid spray apparatus in the first embodiment, which is a third liquid ejecting apparatus.

FIGS. 3 to 5 are schematic configuration diagrams of an interior of the liquid ejecting apparatus 1000 (1000A, 1000B, 1000C) of the first embodiment of the invention, respectively. The liquid ejecting apparatus 1000 of FIGS. 3 to 5 differs in liquid ejection capability. When distinguishing the liquid ejecting apparatus 1000 of FIGS. 3 to 5 in the following description, they will be referred to as a first liquid ejecting apparatus 1000A, a second liquid ejecting apparatus 1000B, and a third liquid ejecting apparatus 1000C, respectively.

As illustrated in FIGS. 3 to 5, the apparatus main body 10 of the liquid ejecting apparatus 1000 includes a case member 11, a liquid ejection unit 12 which has the liquid ejecting head 60, a maintenance unit 13, a liquid supply system 80 which supplies a liquid to the liquid ejecting head 60 (60A, 60B, and 60C) from the liquid container 50, and a support member 40 which supports a part of the liquid supply system 80 (80A, 80B, and 80C). The liquid ejection unit 12 and the maintenance unit 13 are accommodated in an accommodation space portion 14 inside the case member 11.

The liquid ejection unit 12 prints an image on a recording medium by ejecting a liquid, while transporting the recording medium in the X-axis direction (a sub-scanning direction) by an unillustrated transport apparatus and moving the liquid ejecting head 60 in the Y-axis direction (a main scanning direction). The liquid ejecting head 60 is an ink jet head which, for example, drives plural piezoelectric vibrators to eject liquids from plural nozzles. In the liquid ejecting head 60, nozzle arrays are formed for each different types of liquids.

An area called a home position is provided outside a printing area in which the liquid ejecting head 60 is moved in the main scanning direction. The maintenance unit 13 which performs maintenance for a normal printing is disposed in the home position. The maintenance unit 13 includes a cap member 70 which is pressed against a nozzle surface on which nozzles of the liquid ejecting head 60 are formed so as to form a closed space to surround the nozzles, a lifting mechanism (not illustrated) which moves the cap member 70 up and down to press the cap member 70 against the nozzle surface of the liquid ejecting head 60, a suction pump (not illustrated) which introduces negative pressure into the closed space formed when the cap member 70 is pressed against the nozzle surface of the liquid ejecting head 60, and a waste liquid reservoir 71 which contains a liquid sucked via the suction pump.

The liquid supply system 80 includes a head flow path 81, a first relay portion 82, a first flow path 83, a second relay portion 84, and a second flow path 85. The head flow path 81 includes a joint member 86 connected to the liquid ejecting head 60, multi-row type flexible tubular bodies 87 in which flow paths are formed for different type of liquids, a joint member 87*a* connected to the first relay portion 82, a flat cable 72 extending along the tubular bodies 87, plural third guide portions 78 which hold the tubular bodies 87, and a bent support member 79 extending along the tubular bodies 87. One end of the head flow path 81 is connected to the liquid ejecting head 60, and the other end of the head flow path 81 is connected to the first relay portion 82.

The first relay portion 82 connects the head flow path 81 and the first flow path 83, and is accommodated in the accommodation space portion 14 inside the case member 11. Plural first flow paths 83 are provided for different types of liquids. A first flow path 83K through which a black liquid flows is a liquid supply tube which connects the first relay portion 82 and a joint member 91K located at an end of a second flow path 85K extending from the liquid container 50K. The first flow path 83K includes a joint member 88 (hereafter, "joint member 88K") connected to the first relay portion 82, and a joint member (a joint portion) 90K connected to the second relay portion 84.

Similarly, first flow paths 83C, 83M, and 83Y in which cyan, magenta, and yellow liquids flow are liquid supply tubes which connect the first relay portion 82 and the second relay portion 84. The first flow paths 83C, 83M, and 83Y extend in parallel. The first flow paths 83C, 83M, and 83Y includes a joint member 88 (hereafter, "joint members 88C, 88M, and 88Y") connected to the first relay portion 82, and a common joint member (a joint portion) 90 connected to the second relay portion 84. The second relay portion 84 connects the first flow path 83 and the second flow path 85, and is provided to extend over the case member 11 and the case member 22B.

Plural second flow paths 85 are provided for each of black, cyan, magenta, and yellow liquids. The second flow path 85K in which the black liquid flows is a liquid supply tube which connects the joint member 90K and the detachable unit 30K. The second flow paths 85C, 85M, and 85Y in which the cyan, magenta, and yellow liquids flow are liquid supply tubes which connect the second relay portion 84 and the detachable units 30C, 30M, and 30Y, respectively. Each of the second flow paths 85K, 85C, 85M, and 85Y include a joint member 91 (hereafter, "joint members 91K, 91C, 91M, and 91Y") connected to the joint member 90K or the second relay portion 84.

Joint Member

Figure 6:
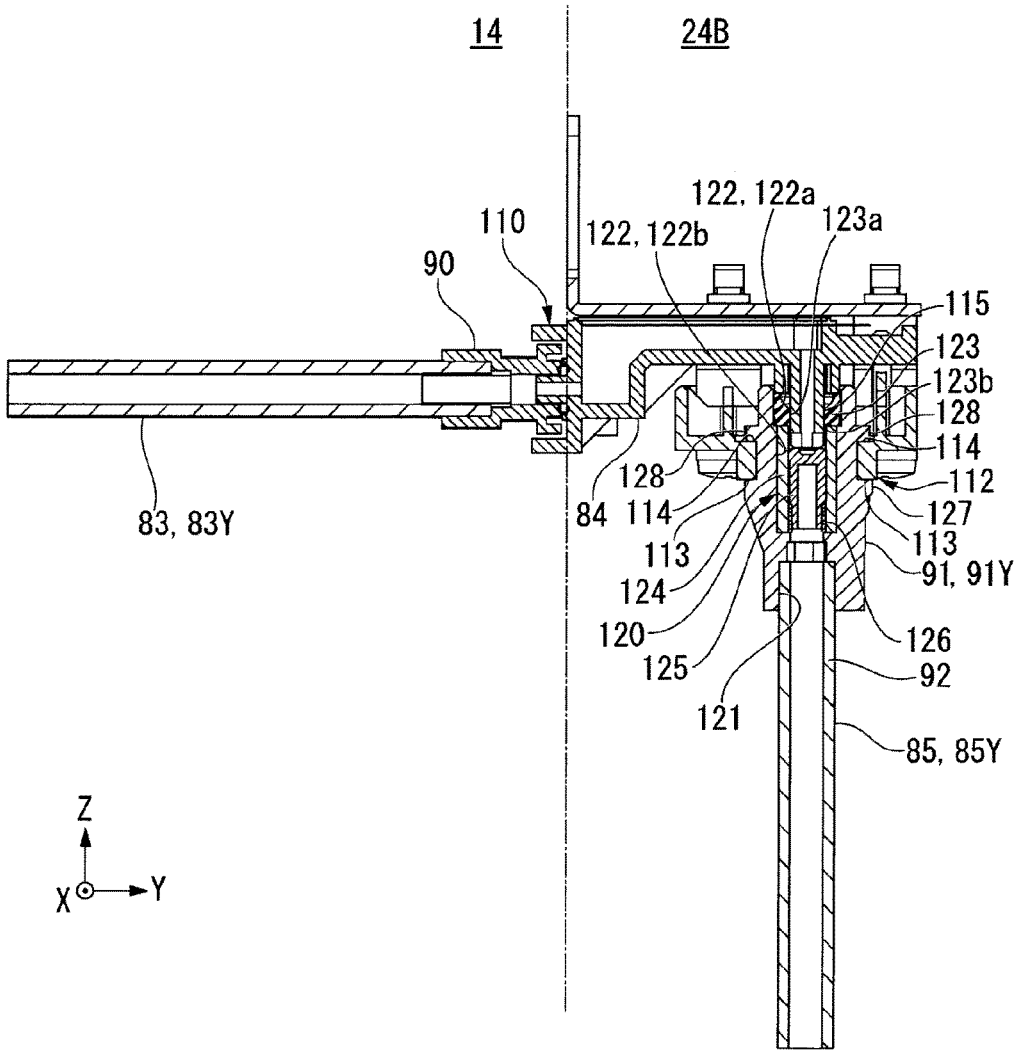
FIG. 6 is a cross-sectional view illustrating a connected state of a joint member to a second relay portion in the first embodiment.
Figure 7:
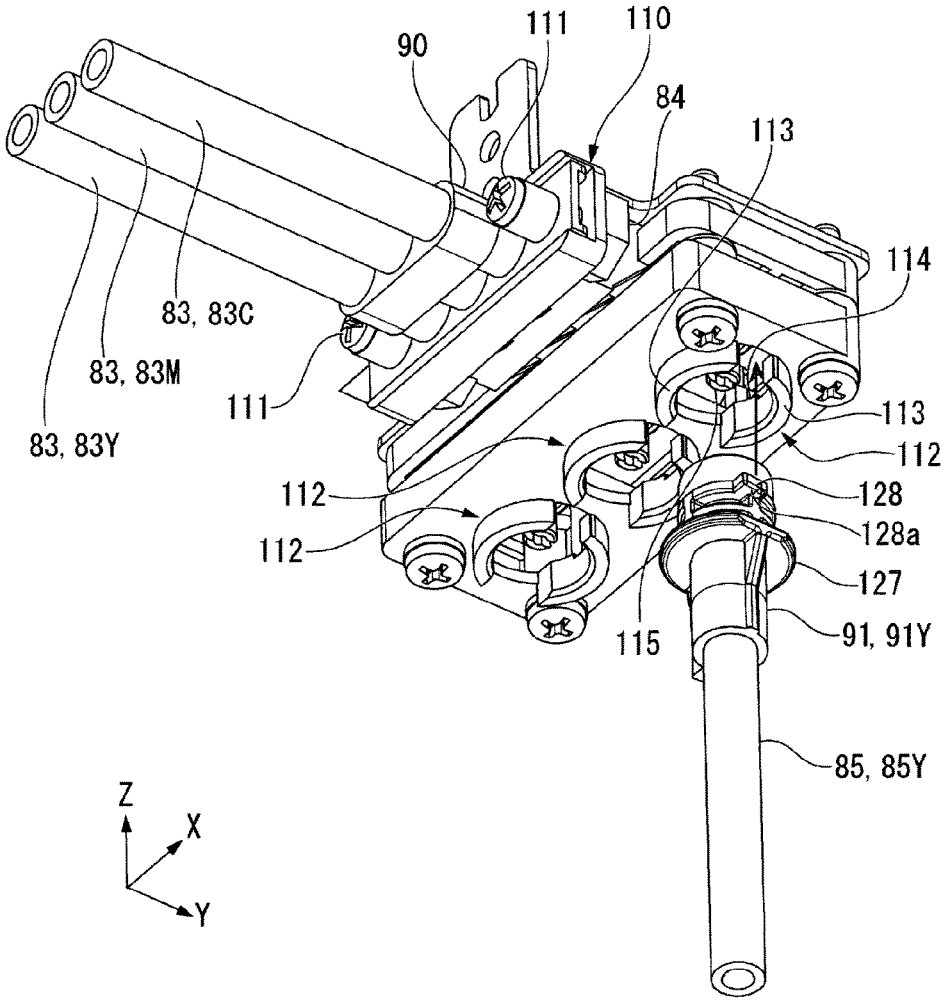
FIG. 7 is a perspective view illustrating a state when connecting the joint member to the second relay portion in the first embodiment.
Figure 8:
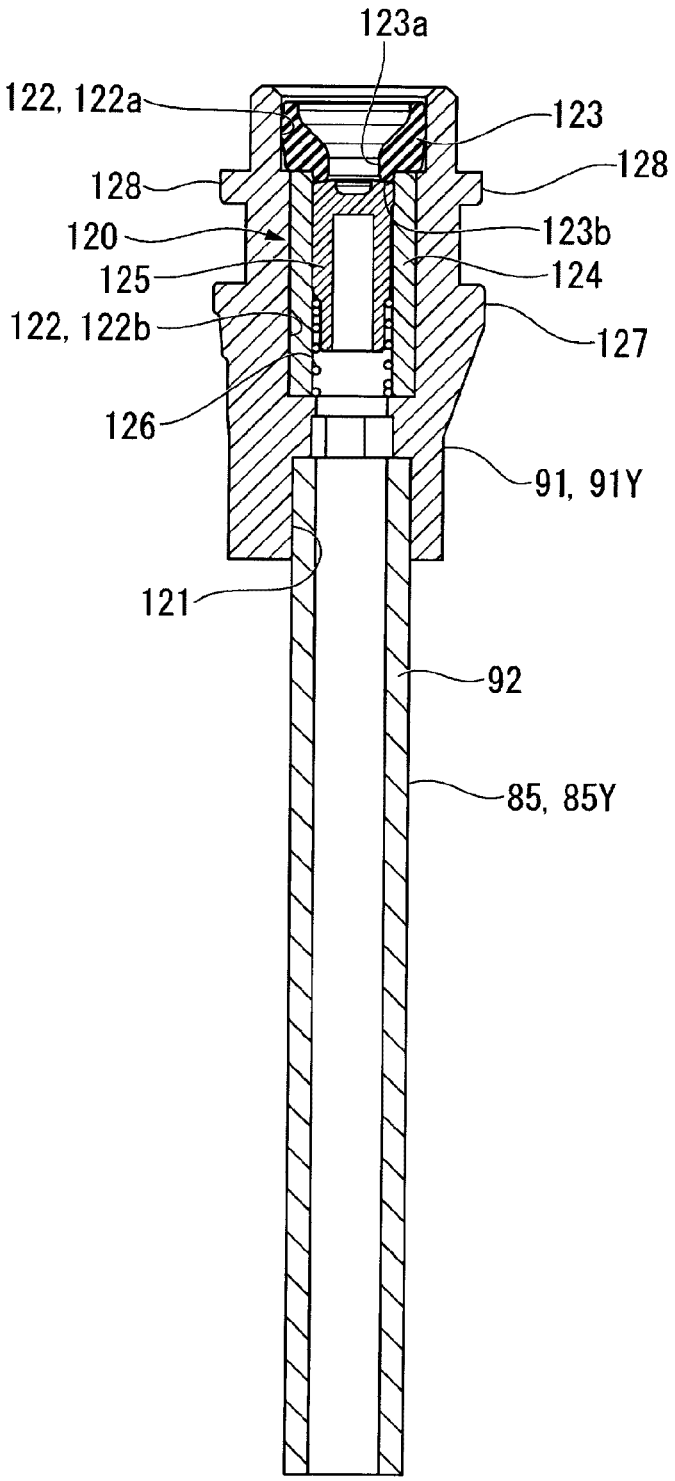
FIG. 8 is a cross-sectional view illustrating a non-connected state of the joint member in the first embodiment.
Figure 9:
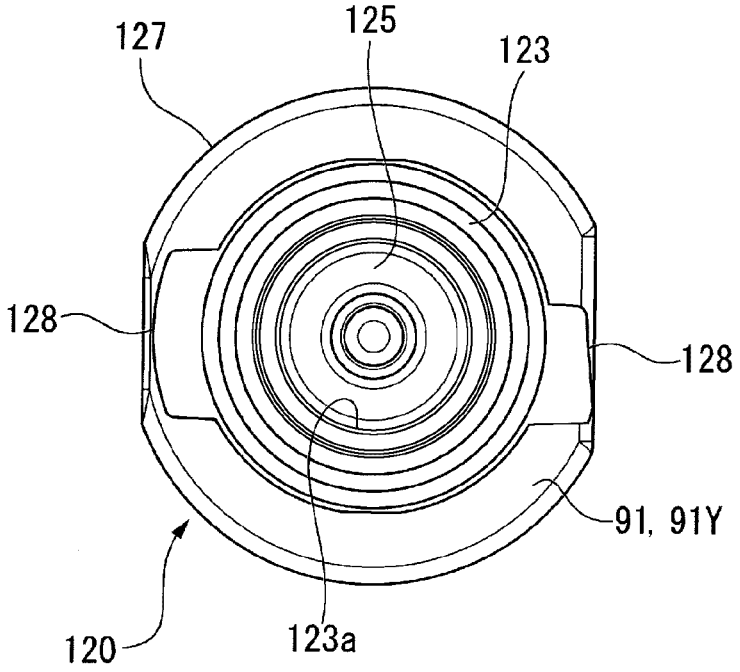
FIG. 9 shows the joint member in the first embodiment seen from a connecting direction.

FIG. 6 is a cross-sectional view illustrating a connected state of the joint members 90 and 91 to the second relay portion 84 in the first embodiment of the invention. FIG. 7 is a perspective view illustrating a state when connecting the joint member 91 to the second relay portion 84 in the first embodiment of the invention. FIG. 8 is a cross-sectional view illustrating a non-connected state of the joint member 91 in the first embodiment of the invention. FIG. 9 shows the joint member 91 in the first embodiment of the invention seen from a connecting direction.

As illustrated in FIGS. 6 and 7, the second relay portion 84 includes a first connecting portion 110 to which the joint member 90 is connected, and a second connecting portion 112 to which the joint member 91 is connected. The first connecting portion 110 is connected to the common joint member 90 of the first flow paths 83C, 83M, and 83Y via fixing members 111 as illustrated in FIG. 7. The fixing members 111 are screw members and fix the first connecting portion 110 and the joint member 90. Since the joint member 90 is located in the accommodation space portion 14 inside the case member 11 as illustrated in FIG. 6, the joint member 90 can be assembled inside the case member 11. As illustrated in FIGS. 3 to 5, since the joint members 86 and 87*a* accommodated in the accommodation space portion 14 inside the case member 11 are relatively largely affected by a movement (for example, vibration) of the liquid ejecting head 60, it is desirable to fix the joint members 86 and 87*a* with screw members or other means in the same manner as the joint member 90.

The second connecting portion 112 is provided in each of the joint members 91C, 91M, and 91Y. As illustrated in FIG. 8, the joint member 91 includes a sealing mechanism 120 which prevents liquid leakage when the second connecting portion 112 is in a non-connected state. Since the sealing mechanisms 120 provided in the joint members 91C, 91M, and 91Y are the same in configuration, a configuration of the sealing mechanism 120 provided in the joint member 91Y will be described below.

The joint member 91 is substantially cylindrical in shape, and includes a fitting groove 121 into which a tubular body 92 which forms a part of the second flow path 85 fits, and an accommodation groove 122 in which the sealing mechanism 120 is accommodated. The accommodation groove 122 is constituted by a large diameter portion 122*a* which opens to a connection surface of the joint member 91, and a small diameter portion 122*b* communicating with the large diameter portion 122*a*. A substantially cylindrical packing 123 formed by elastomer is accommodated in the large diameter portion 122*a*. A ring shaped valve seat 123*b* is formed in the packing 123 to project toward the small diameter portion 122*b* along an edge of an opening 123*a* which penetrates the center of the packing 123.

A cylindrical shaped valve element guide 124 is accommodated in the small diameter portion 122*b*. An inner diameter of the valve element guide 124 is larger than the inner diameter of the packing 123 (the opening 123*a*). A valve element 125 which can be moved close to or away from the valve seat 123*b* is provided inside the valve element guide 124. The valve element 125 has a closed-end cylindrical shape which can close the opening 123*a*. An urging member 126 which urges the valve element 125 in a direction to bring the valve element 125 into close contact with the valve seat 123*b* is provided between the valve element 125 and a bottom surface of the small diameter portion 122*b*. The urging member 126 is a compression spring which brings the valve element 125 into close contact with the valve seat 123*b* of the packing 123 and keeps a closed state.

A flange 127 and a pair of engagement projections 128 are formed in an outer peripheral surface of the joint member 91. As illustrated in FIGS. 6 and 7, the second connecting portion 112 includes a pair of contact portions 113 with which the flange 127 is brought into contact, an engagement groove 114 which the pair of engagement projections 128 engage, and an inserting portion 115 which moves the valve element 125 against urging force of the urging member 126 to make the sealing mechanism 120 an opened state. Each part of the pair of contact portions 113 is formed in an arc shape, and both ends of the arc shaped part face each other with a gap therebetween as illustrated in FIG. 7. The gap between the parts of the pair of contact portions 113 is large enough to let each of the pair of engagement projections 128 be inserted.

As illustrated in FIG. 6, the engagement groove 114 is formed on the back side of the pair of contact portions 113. The pair of engagement projections 128 engage the engagement groove 114 by rotating about a central axis after passing through the space between the parts the pair of contact portions 113. The pair of engagement projections 128 are asymmetrical as illustrated in FIG. 9. As illustrated in FIG. 7, an inclined surface 128*a* is provided in one of the pair of engagement projections 128 for a smooth engagement with the engagement groove 114. This structure enables rotation about the central axis even if the joint member 91 is not inserted completely in the second connecting portion 112. When the joint member 91 is rotated about the central axis, the joint member 91 is inserted deeply in the second connecting portion 112 by the effect of the inclined surface 128*a*.

The inserting portion 115 is disposed at the center of the pair of contact portions 113 as illustrated in FIG. 7. The inserting portion 115 is cylindrical in shape with an end split into two. When the joint member 91 is inserted deeply in the second connecting portion 112, as illustrated in FIG. 6, the end of the inserting portion 115 presses the valve element 125 downward against the urging force of the urging member 126. At this time, the packing 123 is brought into close contact with an outer peripheral surface of the inserting portion 115 to provide a seal. As the valve element 125 is separated from the valve seat 123*b* of the packing 123 to bring about an opened state, in which a liquid from the tubular body 92 passes through a space between the valve element 125 and the valve element guide 124 and flows through a gap at the split end of the inserting portion 115.

It is assumed that the second flow path 85 is removed from the second relay portion 84 for the maintenance of the detachable unit 30. Then, since the end of the inserting portion 115 of the second connecting portion 112 is separated from the valve element 125, as illustrated in FIG. 8, the valve element 125 is brought into close contact with the valve seat 123*b* of the packing 123 by the urging force of the urging member 126, and closes the opening 123*a* of the packing 123 to bring about a valve closed state. As a result, an open end of the connection surface of the joint member 91 is sealed by the sealing mechanism 120. Therefore, leakage of the liquid remaining in the tubular body 92 outside through the open end is prevented.

As described above, since the sealing mechanism 120 is provided in the joint member 91, liquid leakage when the second flow path 85 is removed can be prevented easily. The joint member 91 is accommodated in the accommodation space portion 26B inside the case member 22B as illustrated in FIGS. 3 to 5. For the maintenance of the detachable units 30C, 30M, and 30Y, the second flow path 85 can be removed easily when the case member 22B is opened. Therefore, maintenance can be performed without opening the case member 11. A removable cover member which covers the joint member 91 is desirably provided in the accommodation space portion 26B inside the case member 22B so that a user does not touch the joint member 91 inadvertently.

First to Third Liquid Ejecting Apparatus

Next, different configurations of the first to the third liquid ejecting apparatuses 1000A, 1000B, and 1000C illustrated in FIGS. 3 to 5 will be described. The first to the third liquid ejecting apparatuses 1000A, 1000B, and 1000C differ in liquid ejection capabilities of the liquid ejecting heads 60A, 60B, and 60C and supply capabilities of the liquid supply systems 80A, 80B, and 80C in accordance with the liquid ejection capabilities. Specifically, the first liquid ejecting apparatus 1000A, the second liquid ejecting apparatus 1000B, and the third liquid ejecting apparatus 1000C are in descending order of liquid ejection capability.

The first to the third liquid ejecting apparatuses 1000A, 1000B, and 1000C have different liquid ejecting heads 60A, 60B, and 60C, and different liquid supply systems 80A, 80B, and 80C, respectively. The first to the third liquid ejecting apparatuses 1000A, 1000B, and 1000C have a common support member 40.

As illustrated in FIGS. 3 to 5, the support member 40 is fixed to the case member 11 and is disposed in an internal space of the case member 11. The support member 40 is a sheet metal member which is rectangular in shape extending in the Y-axis direction (the main scanning direction) in a plan view. A first guide portion 41 and a second guide portion 42 are fixed to the support member 40. The first guide portion 41 supports and guides the first flow paths 83C, 83M, and 83Y in bundle in which the cyan, magenta, and yellow liquids flow. The second guide portion 42 supports and guides the first flow path 83K in which the black liquid flows. That is, the first guide portion 41 and the second guide portion 42 support and guide at least a part of the liquid supply system 80.

In the first liquid ejecting apparatus 1000A, a tubular diameter (a sectional area of the flow path) of each of the first flow paths 83K, 83C, 83M, and 83Y and the head flow path 81 is smaller than those in the second and the third liquid ejecting apparatuses 1000B and 1000C. That is, the first liquid ejecting apparatus 1000A has relatively large tube resistance in the first flow paths 83K, 83C, 83M, and 83Y and the head flow path 81, and is suitable for transporting a small amount of liquid. The second and the third liquid ejecting apparatuses 1000B and 1000C have relatively small tube resistance in the first flow paths 83K, 83C, 83M, and 83Y and the head flow path 81, and are suitable for transporting a large amount of liquid. The first flow paths 83K, 83C, 83M, and 83Y of the third liquid ejecting apparatus 1000C further includes a transport auxiliary pump 75 in the path. Therefore, in the third liquid ejecting apparatus 1000C, the liquid supply system 80C is suitable for transporting a still large amount of liquid.

First Guide Portion

In the first liquid ejecting apparatus 1000A, a guide portion for small diameter 41A is provided in the support member 40 as the first guide portion 41. The guide portion for small diameter 41A is provided to keep a small diameter flow path (tube) with a small tubular diameter. In the second and the third liquid ejecting apparatuses 1000B and 1000C, a guide portion for large diameter 41B is provided as the first guide portion 41. The guide portion for large diameter 41B is provided to keep a large diameter flow path (tube) with a large tubular diameter.

Figure 10:
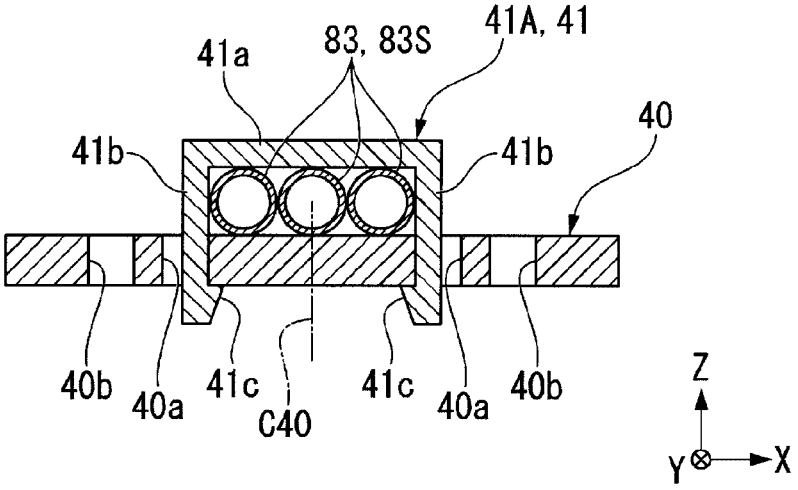
FIG. 10 is a cross-sectional view of a support member of the first liquid ejecting apparatus, a guide portion for small diameter, and three first flow paths in the first embodiment.
Figure 11:
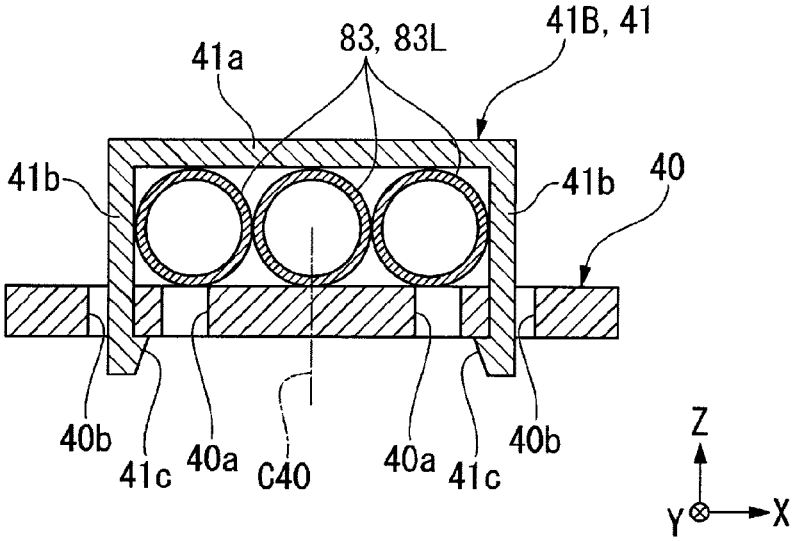
FIG. 11 is a cross-sectional view of a support member of the second and the third liquid ejecting apparatuses, a guide portion for large diameter, and the three first flow paths in the first embodiment.

FIG. 10 is a cross-sectional view of the support member 40, the guide portion for small diameter 41A, and three first flow paths 83 of the first liquid ejecting apparatus 1000A. FIG. 11 is a cross-sectional view of the support member 40, the guide portion for large diameter 41B, and three first flow paths 83 of the second and the third liquid ejecting apparatuses 1000B and 1000C. In the following description, the first flow path of small diameter 83 is referred to as a first flow path 83S, and the first flow path of large diameter 83 is referred to as a first flow path 83L.

A common structure of the guide portion for small diameter 41A and the guide portion for large diameter 41B will be described with reference to FIGS. 10 and 11. The first guide portion 41 (i.e., the guide portion for small diameter 41A and the guide portion for large diameter 41B) is constituted by a resin material or a sheet metal worked metal material, for example. The first guide portion 41 includes a rectangular plate shaped rear surface portion (a guide) 41*a*, and a pair of holding portions (guides) 41*b* extending from both ends of the rear surface portion 41*a* in the width direction toward one side of the rear surface portion 41*a*. Parts of the pair of holding portions 41*b* face each other. Claw portions 41*c* are formed at ends of the holding portions 41*b* to project from surfaces of the holding portions 41*b* facing each other toward the facing holding portions 41*b*. A projecting height of the claw portion 41*c* becomes greater as a distance from a tip end to a base end becomes longer.

A dimension configuration of the pair of holding portions 41*b* mainly differs between the guide portion for small diameter 41A and the guide portion for large diameter 41B. The guide portion for small diameter 41A has a lower extending height in the holding portion 41*b* as compared with the guide portion for large diameter 41B. In the guide portion for small diameter 41A, a distance between parts of the pair of holding portions 41*b* is shorter than that in the guide portion for large diameter 41B.

The guide portion for small diameter 41A and the guide portion for large diameter 41B can be attached to the common support member 40. As illustrated in FIGS. 10 and 11, the support member 40 is provided with a pair of first through holes 40*a* and a pair of second through holes 40*b*. The pair of first through holes 40*a* are symmetrical about a width direction center C40 of the support member 40. Similarly, the pair of second through holes 40*b* are symmetrical about the width direction center C40 of the support member 40. The second through holes 40*b* are located outside of the first through holes 40*a* in the width direction. That is, a distance between the second through holes 40*b* in the width direction is longer than a distance between the first through holes 40*a* in the width direction. Four screw holes 45 are provided in the support member 40. Screws 76 for fixing the transport auxiliary pump 75 can be inserted in the screw holes 45.

As illustrated in FIG. 10, three first flow paths of small diameter 83S (i.e., the first flow paths 83C, 83M, and 83Y through which the cyan, magenta, and yellow liquids flow) can be disposed between the rear surface portion 41*a* of the guide portion for small diameter 41A and the support member 40. The three first flow paths 83S are arranged in the width direction of the support member 40 between the rear surface portion 41*a* and the support member 40. The pair of holding portions 41*b* are located at both ends of the first flow path 83S in an alignment direction and a movement of the three first flow paths 83S in the alignment direction is limited. Ends of the pair of holding portions 41*b* are inserted in the pair of first through holes 40*a* of the support member 40, respectively. The claw portions 41*c* at the ends of the holding portions 41*b* engage the first through holes 40*a* by snap fit. Therefore, the guide portion for small diameter 41A is fixed to the support member 40 while keeping the three first flow paths of small diameter 83S.

As illustrated in FIG. 11, three first flow paths of large diameter 83L can be disposed between the rear surface portion 41*a* of the guide portion for large diameter 41B and the support member 40. Ends of the pair of holding portions 41*b* of the guide portion for large diameter 41B are inserted in the pair of second through holes 40*b* of the support member 40, respectively. The claw portions 41*c* at the ends of the holding portions 41*b* engage the second through holes 40*b* by snap fit. Therefore, the guide portion for large diameter 41B is fixed to the support member 40 while keeping the three first flow paths of large diameter 83L.

As described above, the first guide portion 41 (the guide portion for small diameter 41A and the guide portion for large diameter 41B) includes the guide (the rear surface portion 41*a* and the pair of holding portions 41*b*). The guide has a gate shape, and holds the flow path of the liquid supply system 80 by surrounding from the outside in a radial direction together with the support member 40. Therefore, the guide guides the first flow path 83 along a direction in which the first flow path 83 which is a part of the liquid supply system 80 extends. The first guide portion 41 (the guide portion for small diameter 41A and the guide portion for large diameter 41B) is removably attached to the support member 40.

According to the present embodiment, the support member 40 is provided with the first through holes 40*a* for fixing the guide portion for small diameter 41A, and the second through holes 40*b* for fixing the guide portion for large diameter 41B. Therefore, the guide portion for small diameter 41A and the guide portion for large diameter 41B can be fixed to the common support member 40. The guide portion for small diameter 41A supports and guides the first flow path of small diameter 83S with low liquid transfer capability together with the support member 40 by surrounding a periphery thereof. The guide portion for large diameter 41B supports and guides the first flow path of large diameter 83L with high liquid transfer capability together with the support member 40 by surrounding a periphery thereof. Therefore, according to the present embodiment, flow paths (tubes) with different liquid transfer capabilities can be supported and guided using the common support member 40 by preparing plural types of first guide portions 41 (for example, the guide portion for small diameter 41A and the guide portion for large diameter 41B).

Second Guide Portion

Next, plural types of second guide portions 42 prepared corresponding to plural types of liquid supply systems 80A, 80B, and 80C which are replaceable and which have different liquid supply capabilities will be described.

In the first liquid ejecting apparatus 1000A, as illustrated in FIG. 3, a guide portion for small diameter 42A is provided in the support member 40 as the second guide portion 42. The guide portion for small diameter 42A is provided to keep a small diameter flow path (tube) with a small tubular diameter. As illustrated in FIG. 4, the guide portion for large diameter 42B is provided in the second liquid ejecting apparatus 1000B as the second guide portion 42. The guide portion for large diameter 42B is provided to keep a large diameter flow path (tube) with a large tubular diameter. The third liquid ejecting apparatus 1000C does not include the second guide portion 42.

Figure 12:
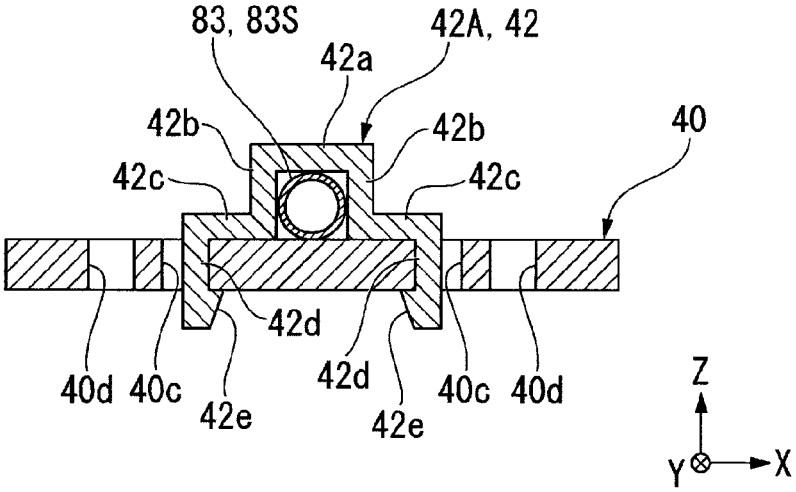
FIG. 12 is a cross-sectional view of a support member of the first liquid ejecting apparatus, a guide portion for small diameter, and a first flow path in the first embodiment.
Figure 13:
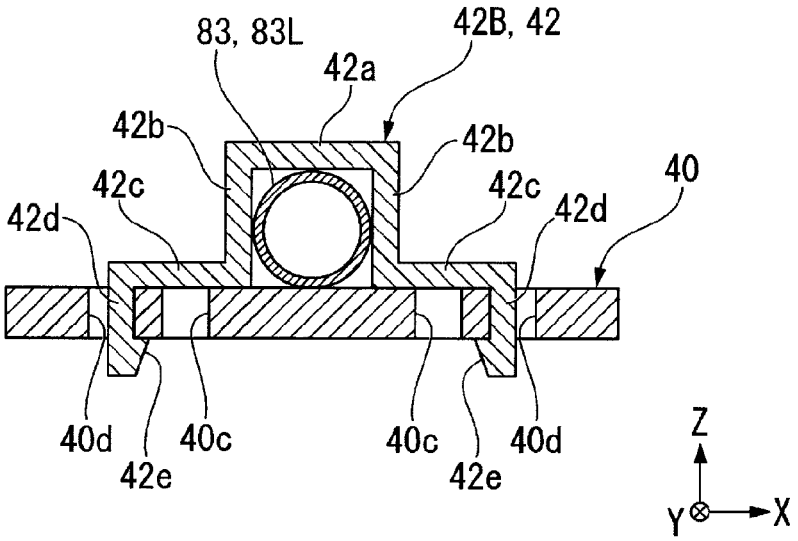
FIG. 13 is a cross-sectional view of a support member of the second and the third liquid ejecting apparatuses, a guide portion for large diameter, and the first flow path in the first embodiment.

FIG. 12 is a cross-sectional view of the support member 40, the guide portion for small diameter 42A, and the first flow path 83S of the first liquid ejecting apparatus 1000A. FIG. 13 is a cross-sectional view of the support member 40, the guide portion for large diameter 42B, and the first flow path 83L of the second and the third liquid ejecting apparatuses 1000B and 1000C.

A common structure of the guide portion for small diameter 42A and the guide portion for large diameter 42B will be described with reference to FIGS. 12 and 13. The second guide portion 42 includes a rectangular plate shaped rear surface portion (a guide) 42*a*, a pair of holding portions (guides) 42*b*, a pair of extended portions 42*c*, and a pair of fixing portions 42*d*. The pair of holding portions 42*b* extend from both ends of the rear surface portion 42*a* in the width direction toward one surface of the rear surface portion 42*a*. The extended portions 42*c* extend outside in the width direction from ends of the holding portions 42*b* in an extending direction. The fixing portions 42*d* extend in the same direction as the extending direction of the holding portions 42*b* from outer ends of the extended portions 42*c* in the width direction. Parts of the pair of fixing portions 42*d* face each other. Claw portions 42*e* are formed at ends of the fixing portions 42*d* to project from surfaces of the fixing portions 42*d* facing each other toward the facing fixing portions 42*d*. A projecting height of the claw portion 42*e* becomes greater as a distance from a tip end to a base end becomes longer.

A dimension configuration of the pair of holding portions 42*b* mainly differs between the guide portion for small diameter 42A and the guide portion for large diameter 42B. The guide portion for small diameter 42A has a lower extending height in the holding portion 42*b* as compared with the guide portion for large diameter 42B. In the guide portion for small diameter 42A, a distance between parts of the pair of holding portions 42*b* is shorter than that in the guide portion for large diameter 42B.

The guide portion for small diameter 42A and the guide portion for large diameter 42B can be attached to the common support member 40. As illustrated in FIGS. 12 and 13, the support member 40 is provided with a pair of third through holes 40*c*, and a pair of fourth through holes 40*d*. The fourth through holes 40*d* are located outside of the third through holes 40*c* in the width direction of the support member 40. That is, a distance between the fourth through holes 40*d* in the width direction is longer than a distance between the third through holes 40*c* in the width direction.

The holding portion 42*b* of the guide portion for small diameter 42A is inserted and held in the third through holes 40*c*. Similarly, the holding portion 42*b* of the guide portion for large diameter 42B is inserted and held in the fourth through holes 40*d*. The extended portions 42*c* are in contact with the one surface of the support member 40. The first flow path of small diameter 83S (the first flow path 83K through which the black liquid flows) can be disposed between the rear surface portion 42*a* of the guide portion for small diameter 42A and the support member 40 (FIG. 12). Similarly, the first flow path of large diameter 83L (the first flow path 83K through which the black liquid flows) can be disposed between the rear surface portion 42*a* of the guide portion for large diameter 42B and the support member 40 (FIG. 13).

As described above, the second guide portion 42 (the guide portion for small diameter 42A and the guide portion for large diameter 42B) includes the guide (the rear surface portion 42*a* and the pair of holding portions 42*b*). The guide is formed in a gate shape, and holds the flow path of the liquid supply system 80 by surrounding from the outside in the radial direction together with the support member 40. Therefore, the guide guides the first flow path 83 along the extension direction in which the first flow path 83 which is a part of the liquid supply system 80 extends. The second guide portion 42 (the guide portion for small diameter 42A and the guide portion for large diameter 42B) is removably attached to the support member 40.

According to the present embodiment, flow paths (tubes) with different liquid transfer capabilities can be supported and guided using the common support member 40 by preparing plural types of second guide portions 42 as in the first guide portions 41.

Transport Auxiliary Pump (Transport Auxiliary Apparatus)

As illustrated in FIG. 5, the liquid supply system 80C of the third liquid ejecting apparatus 1000C includes the transport auxiliary pump 75 in the path of the first flow path 83. The transport auxiliary pump 75 is rectangular in shape when seen in a plan view. Publicly known pumps of any type may be used as the transport auxiliary pump 75.

In the third liquid ejecting apparatus 1000C, the transport auxiliary pump 75 is fixed to the support member 40 with the four screws 76. The screws 76 and the screw holes 45 constitute a fixing structure 77 which fixes the transport auxiliary pump 75 to the support member 40. Since the support member 40 includes the fixing structure 77, the first flow paths 83K, 83C, 83M, and 83Y can be supported more reliably by the support member 40 even in a configuration in which the transport auxiliary pump 75 is provided. In the liquid supply systems 80A and 80B of the first and the second liquid ejecting apparatuses 1000A and 1000B, the fixing structure 77 constituted by the screw holes 45 and the screws 76 is not used.

In the third liquid ejecting apparatus 1000C, the liquid supply system 80C includes the transport auxiliary pump (the transport auxiliary apparatus) 75 which assists transport of the liquid. Therefore, the third liquid ejecting apparatus 1000C has improved liquid supply capability. According to the present embodiment, since the support member 40 has the fixing structure 77, the transport auxiliary pump 75 can be reliably supported and fixed.

Although an example in which the transport auxiliary pump 75 is employed as the transport auxiliary apparatus in the third liquid ejecting apparatus 1000C is described, other configurations may be employed. For example, a configuration in which the liquid contained in the liquid container 50 is supplied to the liquid ejecting head 60C using a water head difference caused by providing the liquid container 50 at a position higher than the liquid ejecting head 60 may be employed.

Third Guide Portion

Figure 14:
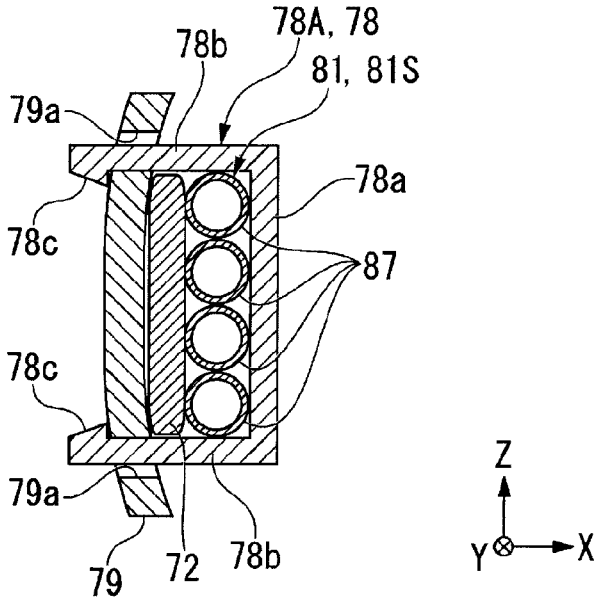
FIG. 14 is a cross-sectional view of a head flow path, a flat cable, a third guide portion, and a bent support member of the first liquid ejecting apparatus in the first embodiment.
Figure 15:
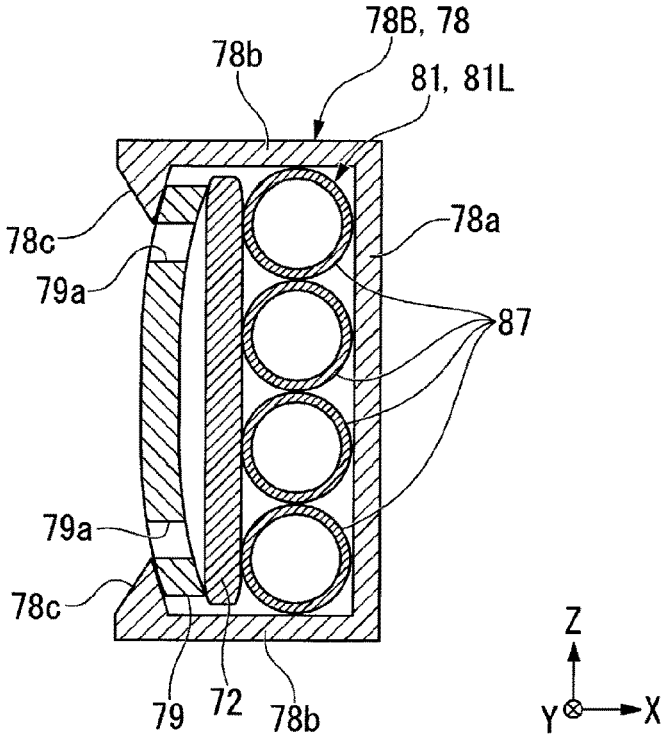
FIG. 15 is a cross-sectional view of a head flow path, a flat cable, a third guide portion, and a bent support member of the second and the third liquid ejecting apparatuses in the first embodiment.

FIGS. 14 and 15 are cross-sectional views of the tubular bodies 87 of the head flow path 81, the flat cable 72, the third guide portion 78, and the bent support member 79. The third guide portion 78 supports and guides the tubular bodies 87 and the flat cable 72. That is, the third guide portion 78 supports and guides at least a part of the liquid supply system 80.

In the first liquid ejecting apparatus 1000A, a guide portion for small diameter 78A is provided as the third guide portion 78. The guide portion for small diameter 78A is provided to hold the head flow path 81 with relatively small tubular diameter and low liquid transfer capability. In the second and the third liquid ejecting apparatuses 1000B and 1000C, a guide portion for large diameter 78B is provided as the third guide portion 78. The guide portion for large diameter 78B is provided to hold the head flow path 81 with relatively large tubular diameter and high liquid transfer capability. In the following description, the head flow path of small diameter 81 is referred to as a head flow path 81S, and the head flow path of large diameter is referred to as a head flow path 81L.

The bent support member 79 is formed by a metal material, such as a stainless steel plate. The bent support member 79 extends as a belt in a longitudinal direction of the tubular bodies 87. As illustrated in FIG. 14, the tubular bodies 87 and the flat cable 72 are held by the third guide portion 78 in the bent support member 79. The bent support member 79 is bent in the width direction in cross-section. Therefore, just as a steel measuring tape, the bent support member 79 can both be kept straight when extended linearly and be bent flexibly. The bent support member 79 can hold the tubular bodies 87 straight. A pair of through holes 79*a* for fixing holding portions 78*b* are formed in the bent support member 79.

The head flow path 81 has a configuration in which four tubular bodies 87 through which the black, cyan, magenta, and yellow liquids flow are arranged in bundle. The flat cable 72 extends along the tubular bodies 87, is branched at a position near the first relay portion 82 and is connected to an unillustrated control unit. The flat cable 72 is disposed between the bent support member 79 and the tubular bodies 87.

Next, the third guide portion 78 (the guide portion for small diameter 78A and the guide portion for large diameter 78B) will be described. First, a common structure of the guide portion for small diameter 78A and the guide portion for large diameter 78B will be described. The third guide portion 78 is formed by a resin material or a sheet metal worked metal material, for example. The third guide portion 78 includes a rectangular plate shaped rear surface portion (a guide) 78*a*, and a pair of holding portions (guides) 78*b* extending from both ends of the rear surface portion 78*a* in the width direction toward one side of the rear surface portion 78*a*. Parts of the pair of holding portions 78*b* face each other. Claw portions 78*c* are formed at ends of the holding portions 78*b* to project from surfaces of the holding portions 78*b* facing each other toward the facing holding portions 78*b*. A projecting height of the claw portion 78*c* becomes greater as a distance from a tip end to a base end becomes longer.

A dimension configuration of the pair of holding portions 78*b* mainly differs between the guide portion for small diameter 78A and the guide portion for large diameter 78B. The guide portion for small diameter 78A has a lower extending height in the holding portion 78*b* as compared with the guide portion for large diameter 78B. In the guide portion for small diameter 78A, a distance between parts of the pair of holding portions 78*b* is shorter than that in the guide portion for large diameter 78B.

The guide portion for small diameter 78A and the guide portion for large diameter 78B can be attached to the common bent support member 79. As illustrated in FIG. 14, the head flow path 81 including the tubular bodies of small diameter 87 can be disposed between the rear surface portion 78*a* of the guide portion for small diameter 78A and the bent support member 79. Ends of the pair of holding portions 78*b* are inserted in the through holes 79*a* of the bent support member 79. The claw portions 78*c* at the ends of the holding portions 78*b* engage the through holes 79*a* by snap fit. Therefore, the guide portion for small diameter 78A is fixed to the bent support member 79 while keeping the head flow path 81.

As illustrated in FIG. 15, the head flow path 81L including the tubular bodies of large diameter 87 can be disposed between the rear surface portion 78*a* of the guide portion for large diameter 78B and the bent support member 79. Ends of the pair of holding portions 78*b* extend outside of the bent support member 79 in the width direction. The claw portions 78*c* at the ends of the holding portions 78*b* engage an edge of the bent support member 79 by snap fit. Therefore, the guide portion for large diameter 78B is fixed to the bent support member 79 while keeping the head flow path of large diameter 81L.

As described above, the third guide portion 78 (the guide portion for small diameter 78A and the guide portion for large diameter 78B) includes the guide (the rear surface portion 78*a* and the pair of holding portions 78*b*). The guide holds the flow path of the liquid supply system 80 by surrounding from the outside in the radial direction together with the bent support member 79. Therefore, the guide guides the head flow path 81 along the extension direction in which the head flow path 81 which is a part of the liquid supply system 80 extends. The third guide portion 78 (the guide portion for small diameter 78A and the guide portion for large diameter 78B) is removably attached to the bent support member 79.

According to the present embodiment, by preparing plural types of third guide portions 78 as in the first guide portions 41 and the second guide portions 42, flow paths (tubes) with different liquid transfer capabilities can be supported and guided using the common bent support member 79.

According to the liquid ejecting apparatus 1000 of the present embodiment, since the removable joint members (joint portions) 86, 87*a*, 88, 90, and 90K are provided at both ends of a part of the liquid supply system 80, a part of the liquid supply system 80 is replaceable and plural types of liquid supply systems 80A, 80B, and 80C can be mounted. Therefore, depending on ejection capability of the liquid ejecting head 60 (for example, the number of nozzles capable of ejecting a liquid), the liquid supply system 80 can be selected from among plural types of liquid supply systems with different liquid supply capabilities (for example, the tubular diameter and the liquid supply method) and employed. The liquid ejecting apparatus 1000 of the present embodiment includes the support member 40 and the bent support member 79 in which plural types of guide portions can be provided depending on the tubular diameter of the liquid supply system 80. Therefore, the common support member 40 and bent support member 79 can be used in plural types of liquid ejecting apparatuses 1000 with different ejection capabilities. Thus, common parts can be used to reduce manufacturing cost and parts management cost.

First Modification

Next, guide portions 141 and a support member 140 of a modification applicable to the liquid ejecting apparatus 1000 of the first embodiment will be described. In the following description, configurations the same as or equivalent to those of the embodiment described above will be denoted by the same reference numerals and description thereof will be simplified or omitted.

Figure 16:
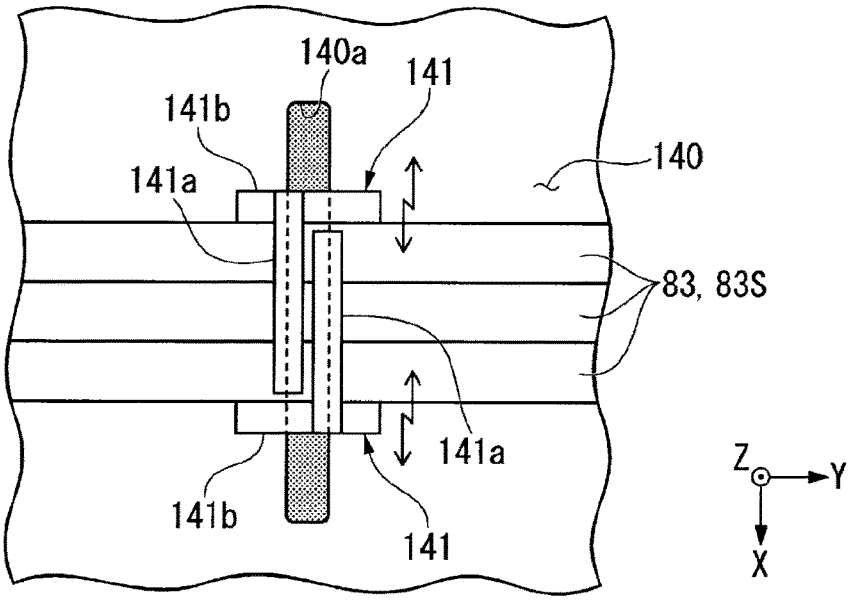
FIG. 16 is a schematic configuration diagram of a support member, a guide portion, and three first flow paths of First Modification seen from above.
Figure 17:
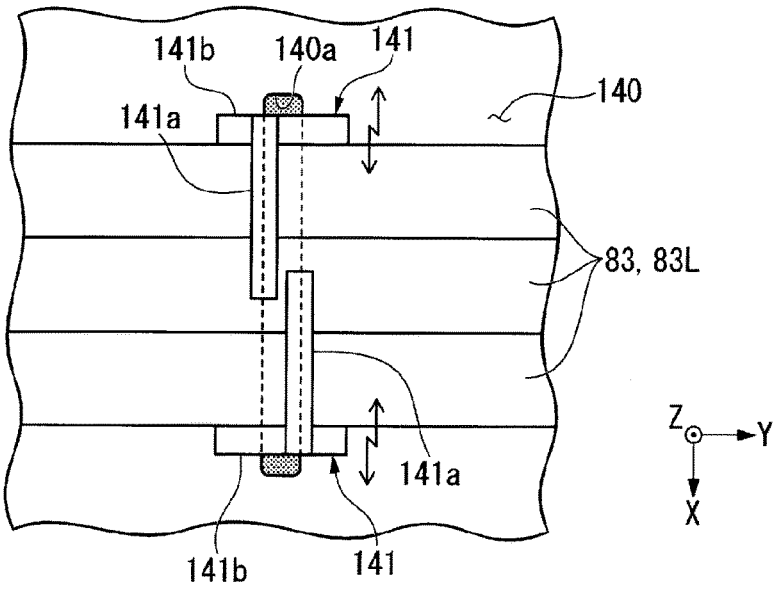
FIG. 17 is a schematic configuration diagram of a support member, a guide portion, and three first flow paths of First Modification seen from above.

FIGS. 16 and 17 are schematic configuration diagrams of the support member 140, the guide portions 141, and three first flow paths 83 of this modification seen from above. The guide portions 141 of this modification differ from those of the first embodiment in a fixing method to the support member 140.

An elongated hole 140*a* extending in an alignment direction of the three first flow paths 83 is formed in the support member 140. A pair of guide portions 141 are attached to the elongated hole 140*a*. The pair of guide portions 141 are movable in the longitudinal direction of the elongated hole 140*a*.

Parts of the pair of guide portions 141 each include a rear surface portion (a guide) 141*a* extending in the longitudinal direction of the elongated hole 140*a*, and a holding portion (a guide) 141*b* located at one end of the rear surface portion 141*a* in the longitudinal direction. The holding portions 141*b* are inserted to be movable at lower ends thereof in the longitudinal direction of the elongated hole 140*a*. The pair of holding portions 141*b* nip first flow paths of small diameter 83S or first flow paths of large diameter 83L from outside in the alignment direction. The rear surface portions 141*a* extend in the same direction. The pair of rear surface portions 141*a* at least partially overlap the first flow paths 83 in the longitudinal direction even if the pair of guide portions 141 are moved in the alignment direction of the three first flow paths 83. The pair of rear surface portions 141*a* hold the first flow paths of small diameter 83S or the first flow paths of large diameter 83L together with the support member 140.

According to the support member 140 of this modification, the parts of the pair of guide portions 141 can be moved close to or away from each other. Therefore, depending on the magnitude of the tubular diameter (the sectional area of the flow path) of the first flow path 83, the pair of guide portions 141 can be brought into contact with and support the first flow paths 83 in the alignment direction. That is, according to this modification, flow paths (tubes) with different liquid transfer capabilities can be supported and guided using a single type of guide portion 141 and a single type of support member 140. Thus, common parts can be used to reduce manufacturing cost and parts management cost.

Second Modification

Next, a support member 240 which includes a guide portion 241 of a modification applicable to the liquid ejecting apparatus 1000 of the first embodiment will be described. In the following description, configurations the same as or equivalent to those of the embodiment described above will be denoted by the same reference numerals and description thereof will be simplified or omitted.

Figure 18:
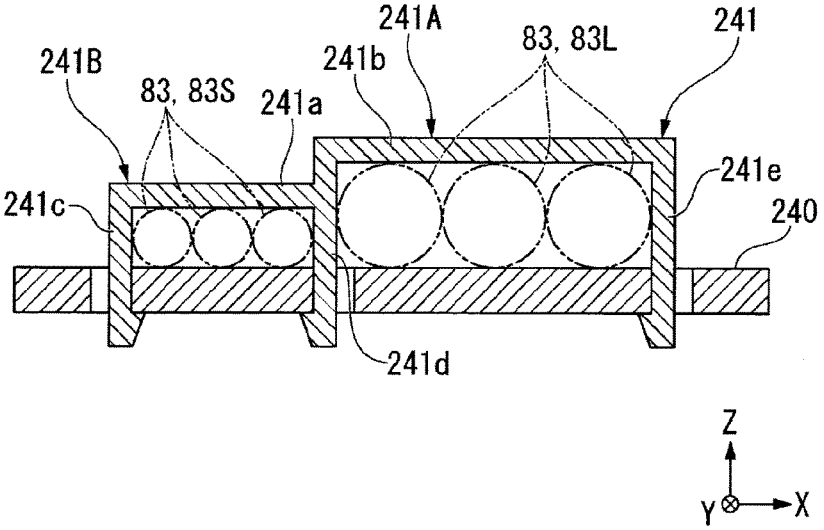
FIG. 18 is a cross-sectional view of a support member of Second Modification.

FIG. 18 is a cross-sectional view of a support member 240 of this modification. In contrast to the above-described first embodiment, the support member 240 of this modification is provided with plural types of guide portions for supporting and guiding plural types of first flow paths 83 which are a part of a liquid supply system 80. Specifically, the support member 240 is provided with a guide portion for small diameter 241A which guides first flow paths of small diameter 83S and a guide portion for large diameter 241B which guides first flow paths of large diameter 83L.

The guide portion for small diameter 241A and the guide portion for large diameter 241B constitute a guide member 241 which is an integrated member. The guide member 241 includes two rear surface portions (guides) 241*a* and 241*b* and three holding portions (guides) 241*c*, 241*d*, and 241*e*. The rear surface portions 241*a* and 241*b* each have a rectangular plate shape extending in parallel with the plate-shaped support member 240. The two rear surface portions 241*a* and 241*b* are formed in different levels. The rear surface portion 241*a* is closer to the support member 240 than the rear surface portion 241*b*. The three holding portions 241*c*, 241*d*, and 241*e* extend toward one side from a plate surface of the rear surface portions 241*a* and 241*b*. Two holding portions 241*c* and 241*e* among the three holding portions 241*c*, 241*d*, and 241*e* extend from width direction ends of the rear surface portions 241*a* arranged in the width direction. The remaining holding portion 241*d* extends from a portion between the two rear surface portions 241*a* and 241*b*.

The guide member 241 constitutes the gate shaped guide portion for small diameter 241A by the rear surface portion 241*a* and the pair of holding portions 241*c* and 241*d*, and constitutes the gate shaped guide portion for large diameter 241B by the rear surface portion 241*b* and the pair of holding portions 241*d* and 241*e*. The guide portion for small diameter 241A can support and guide the three first flow paths of small diameter 83S. The guide portion for large diameter 241B can support and guide the three first flow paths of large diameter 83L.

According to the support member 240 of this modification, which of the guide portion for small diameter 241A and the guide portion for large diameter 241B is to be used to support the first flow paths 83 can be selected depending on the type of the first flow paths 83. According to this configuration, the common support member 240 can be used in plural types of liquid ejecting apparatuses with different ejection capabilities. Thus, common parts can be used to reduce manufacturing cost and parts management cost.

Third Modification

Next, a liquid ejecting head 360 and a liquid supply system 380 of a modification applicable to the liquid ejecting apparatus 1000 of the first embodiment will be described. In the following description, configurations the same as or equivalent to those of the embodiment described above will be denoted by the same reference numerals and description thereof will be simplified or omitted.

Figure 19:
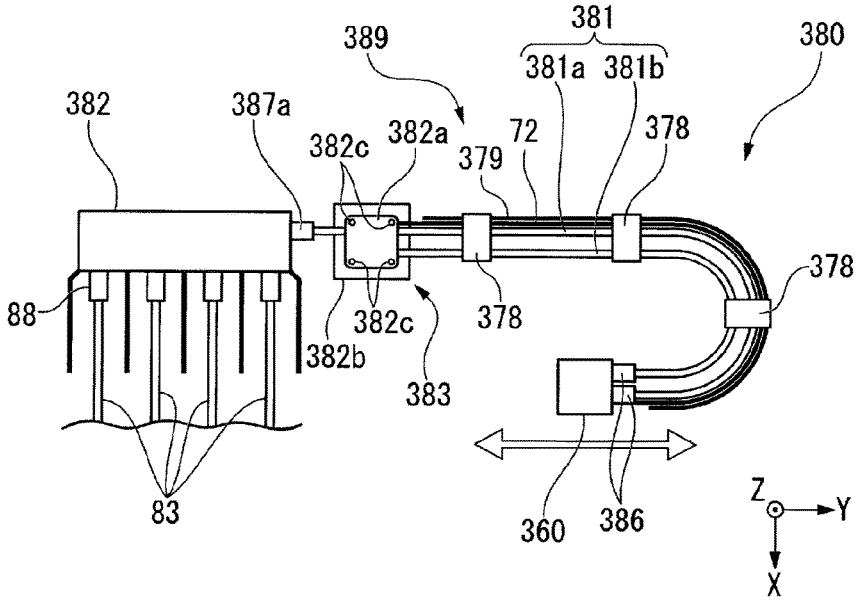
FIG. 19 is a schematic configuration diagram illustrating a part of a liquid supply system of Third Modification.

FIG. 19 is a schematic configuration diagram illustrating a part of the liquid supply system 380 of this modification. The liquid supply system 380 of the present embodiment differs from the liquid supply system of the above-described first embodiment in that the liquid supply system 380 is provided with a circulating portion 389 including a head flow path in which a liquid circulates (a circulation flow path) 381 and a circulator pump 382*a*, and a different support structure supporting the same.

The liquid supply system 380 is provided with a relay portion 382, the head flow path 381 including a forward tubular body 381*a* and a backward tubular body 381*b* and connecting between the liquid ejecting head 360 and the relay portion 382, a circulator pump 382*a*, and first flow paths 83.

The head flow path 381 constituted by the forward tubular body 381*a* and the backward tubular body 381*b*, and the circulator pump 382*a* constitute the circulating portion 389 which circulates a fluid to be supplied between the liquid ejecting head 360 and the relay portion 382.

In addition to the forward tubular body 381*a* and the backward tubular body 381*b*, the head flow path 381 further includes joint members 386 and 387*a*, a flat cable 72, plural third guide portions 378, a bent support member (a support member) 379, and a support member for pump (a supporting member) 382*b* provided with four screws 382*c* as in the first embodiment. The joint members 386 and 387*a* are located at both ends of the circulating portion 389. The flat cable 72 extends along the forward tubular body 381*a* and the backward tubular body 381*b*.

The bent support member 379 extends as a belt in the longitudinal direction of the forward tubular body 381*a* and the backward tubular body 381*b*. The forward tubular body 381*a* and the backward tubular body 381*b* are held by the third guide portions 378 in the bent support member 379 as in the first embodiment. The bent support member 379 is bent in the width direction in cross-section and has straightness and flexibility.

The third guide portions 378 hold the forward tubular body 381*a* and the backward tubular body 381*b*. Plural types of the third guide portions 378 are prepared as in the first embodiment. Depending on the tubular diameter of the forward tubular body 381*a* and the backward tubular body 381*b*, suitable third guide portions 378 are selected from among plural types of third guide portions 378 and attached to the bent support member 379, and the third guide portions 378 support and guide the forward tubular body 381*a* and the backward tubular body 381*b*. Thus, common parts can be used to reduce manufacturing cost and parts management cost.

The circulator pump 382*a* is fixed to the support member 382*b* for pump with the four screws 382*c*. The support member 382*b* for pump is fixed to a part of a case member 11 (see FIG. 3). The support member 382*b* for pump may be a part of the case member 11. The four screws 382*c* constitute a fixing structure 383 for fixing the circulator pump 382*a* to the support member 382*b* for pump. Since the fixing structure 383 is provided in the support member 382*b* for pump, the circulating portion 389 can be supported reliably in a configuration in which the circulator pump 382*a* is provided.

In the liquid supply system 380 of this modification, deposition of components included in the liquid is reduced by circulating the liquid, whereby degradation of liquid components and occurrence of unevenness can be prevented. Further, air bubbles generated near nozzles of the liquid ejecting head 360 can be removed by circulating the liquid, whereby an amount of the liquid ejected from the nozzles can be stabilized.

In this modification, the fixing structure 383 which supports and fixes the third guide portions 378 supporting the head flow path (the circulation flow path) 381 and the circulator pump 382*a* is provided in each of the two support members (the bent support member 379 and the support member 382*b* for pump). Alternatively, a guide portion which supports a circulation flow path, and a fixing structure which fixes a circulator pump may be provided in a single support member, or either of the guide portion or the fixing structure may be provided in a single support member.

Although embodiments of the invention have been described with reference to the drawings, the invention is not limited to the same. Shapes, combinations, etc. of each components described in the embodiments are illustrative only, and may be changed without departing from the spirit and scope of the invention based on a design request, etc.

For example, although a case in which the support member is fixed to the case member of the apparatus main body is described in the above embodiment, other configurations may be employed. For example, the support member may be a part of the case member.

The liquid spray apparatus of the above embodiment employs a replaceable ink pack system (RIPS) in which large capacity ink packs are mounted as liquid containers. However, the invention may employ any types of off-carriage liquid spray apparatus in which a liquid container and a liquid ejecting head are connected via a liquid supply system including a flexible tube. Therefore, the liquid container may be a cartridge, a bottle, a reservoir to which a liquid can be added.

The liquid ejecting apparatus in the above embodiment may be a thermal jet printer or a line ink jet printer. The liquid ejecting apparatus is not limited to a printer and may be other apparatuses, such as a copier and a facsimile machine.

The liquid ejecting apparatus may eject or discharge other liquids than ink. The invention is applicable to various liquid ejecting apparatuses provided with a liquid ejecting head etc. which ejects a very small amount of droplets, for example. A droplet herein is a state of a liquid ejected from the liquid ejecting apparatus, and includes a granular state, a teardrop shaped state, and a stringy state. The liquid herein may be a material that can be ejected from the liquid ejecting apparatus. For example, it is only necessary that the liquid is a substance in a liquid phase and may include a liquid material with high or low viscosity, a material in a flowing state like sol, gel water, other inorganic solvents, organic solvents, solutions, liquefied resin, and liquefied metal (metal melt). In addition to a liquid as a state of a substance, the liquid also includes an object in which particles of a functional material consisting of solids, such as pigment and metal particles, are dissolved, distributed or mixed in a solvent. A typical example of the liquid is ink as described in the above embodiments. The ink herein may include various liquid compositions, such as common water-based ink, oil-based ink, gel ink, and hot melt ink.

The entire disclosure of Japanese Patent Application No. 2016-021155, filed Feb. 5, 2016 is expressly incorporated by reference herein.

What is claimed is:

1. A liquid ejecting apparatus, comprising:

a liquid ejecting head that ejects liquid;

a liquid supply system that supplies the liquid from a liquid storing portion for containing the liquid to the liquid ejecting head; and a common support member provided with a guide portion that supports and guides at least a part of the liquid supply system, wherein the liquid supply portion includes a first removable joint portion that is provided at a first end of the at least a part of the liquid supply system, a second removable joint portion that is provided at a second end of the at least part of the liquid supply system, and a relay flow path whose one open end is connected to the liquid storing portion and the other end is connected to the first removable joint portion, wherein the common support member is configured to mount another liquid supply system in place of the at least a part of the liquid supply system mounted.

2. The liquid ejecting apparatus according to claim 1, wherein the liquid supply system in accordance with liquid ejection capability of the liquid ejecting head among a plurality of types of the liquid supply systems that can be mounted on the support member.

3. The liquid ejecting apparatus according to claim 1, wherein the guide portion includes a guide that supports and guides a flow path of the liquid supply system together with the support member along an extension direction in which the liquid supply system extends.

4. The liquid ejecting apparatus according to claim 1, wherein the guide portion is removably attached to the support member.

5. The liquid ejecting apparatus according to claim 1, wherein the guide portion is movably attached to the support member.

6. The liquid ejecting apparatus according to claim 1, wherein a plurality of types of guide portions that support and guide a plurality of types of the liquid supply systems, respectively, can be provided in the support member.

7. The liquid ejecting apparatus according to claim 1, wherein the liquid supply system includes a pump that assists transport of the liquid, and the common support member includes a fixing structure which supports and fixes the pump.

8. The liquid ejecting apparatus according to claim 1, wherein the liquid supply system includes a circulating portion that has a circulation flow path and a circulator pump to circulate the liquid, removable joint portions are provided at both ends of the circulating portion, and at least one of the guide portion that supports the circulation flow path and a fixing structure that supports and fixes the circulator pump is provided in the support member.

9. The liquid ejecting apparatus according to claim 1, wherein the at least a part of the liquid supply system includes a plurality of supply flow paths, wherein the first removable joint portion is provided at the first end of each of the plurality of supply flow paths, wherein the second removable joint portion is provided at the second end of each of the plurality of supply flow paths, and wherein at least one of the first removable joint portion and the second removable joint portion is integrally provided with respect to the plurality of the supply flow paths.

10. The liquid ejecting apparatus according to claim 1, wherein the relay flow path is not supported by the common support member.

11. A liquid ejecting apparatus, comprising:

a liquid ejecting head that ejects liquid;

a liquid supply system that supplies the liquid from a liquid storing portion for containing the liquid to the liquid ejecting head; and a common support member provided with a guide portion that supports and guides at least a part of the liquid supply system, wherein the liquid supply system includes a first removable joint portions that is provided at a first ends of the at least a part of the liquid supply system, a second removable joint portion that is provided at a second end of the at least a part of the liquid supply system, and a relay flow path whose one end is connected to the liquid storing portion and the other end is connected to the first removable joint portion, wherein a plurality of different types of liquid supply systems that are different from each other can be mounted on the common support member separately from each other such that only one of the plurality of different types of liquid supply systems is mounted on the common support member at a time.

12. The liquid ejecting apparatus according to claim 11, wherein the at least a part of the liquid supply system includes a plurality of supply flow paths, wherein the first removable joint portion is provided at the first end of each of the plurality of supply flow paths, wherein the second removable joint portion is provided at the second end of each of the plurality of supply flow paths, and wherein at least one of the first removable joint portion and the second removable joint portion is integrally provided with respect to the plurality of the supply flow paths.

13. The liquid ejecting apparatus according to claim 11, wherein the relay flow path is not supported by the common support member.

14. A liquid ejecting apparatus, comprising:

a liquid ejecting head that ejects liquid;

a liquid supply system that supplies the liquid from a liquid storing portion for containing the liquid to the liquid ejecting head; and a common support member provided with a guide portion that supports and guides at least a part of the liquid supply system, wherein removable joint portions are provided at both ends of the at least a part of the liquid supply system, wherein the common support member is configured to mount another liquid supply system in place of the liquid supply system mounted, and wherein the liquid supply system includes a circulating portion that has a circulation flow path and a circulator pump to circulate the liquid, removable joint portions are provided at both ends of the circulating portion, and at least one of the guide portion that supports the circulation flow path and a fixing structure that supports and fixes the circulator pump is provided in the support member.

* * * * *